US007819517B2

(12) United States Patent
Sato

(10) Patent No.: US 7,819,517 B2
(45) Date of Patent: Oct. 26, 2010

(54) ULTRAVIOLET RAY IRRADIATION APPARATUS FOR FIXING PRINTED MATERIAL

(75) Inventor: Mitsuo Sato, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 827 days.

(21) Appl. No.: 11/679,443

(22) Filed: Feb. 27, 2007

(65) Prior Publication Data

US 2007/0268355 A1 Nov. 22, 2007

(30) Foreign Application Priority Data

May 16, 2006 (JP) ..... 2006-136909

(51) Int. Cl.
*B41F 23/04* (2006.01)
*B41L 23/20* (2006.01)

(52) U.S. Cl. ..... 347/102; 347/212

(58) Field of Classification Search ..... 347/101, 347/102, 212; 101/118, 128.4
See application file for complete search history.

(56) References Cited

U.S. PATENT DOCUMENTS

2006/0219106 A1* 10/2006 Sato ..... 101/128.4
2007/0012204 A1* 1/2007 Sato ..... 101/118

FOREIGN PATENT DOCUMENTS

JP 4-35188 8/1992
JP 5-64878 3/1993

* cited by examiner

*Primary Examiner*—Huan H Tran
(74) *Attorney, Agent, or Firm*—Oblon, Spivak, McClelland, Maier & Neustadt, L.L.P.

(57) ABSTRACT

In an ultraviolet ray irradiation apparatus capable of forestalling printed material jams between a paper discharge unit of a printing apparatus and a reception unit of the ultraviolet ray irradiation apparatus, a signal line for exchanging electric signals with the printing apparatus is provided, and control is performed such that rotational driving of a paper conveyance belt of the ultraviolet ray irradiation apparatus is begun upon reception of a printing drum rotation start signal or a paper feeding unit paper conveyance start signal, and the rotational driving of the belt is halted after a predetermined amount of time has elapsed following reception of a printing completion signal.

7 Claims, 9 Drawing Sheets

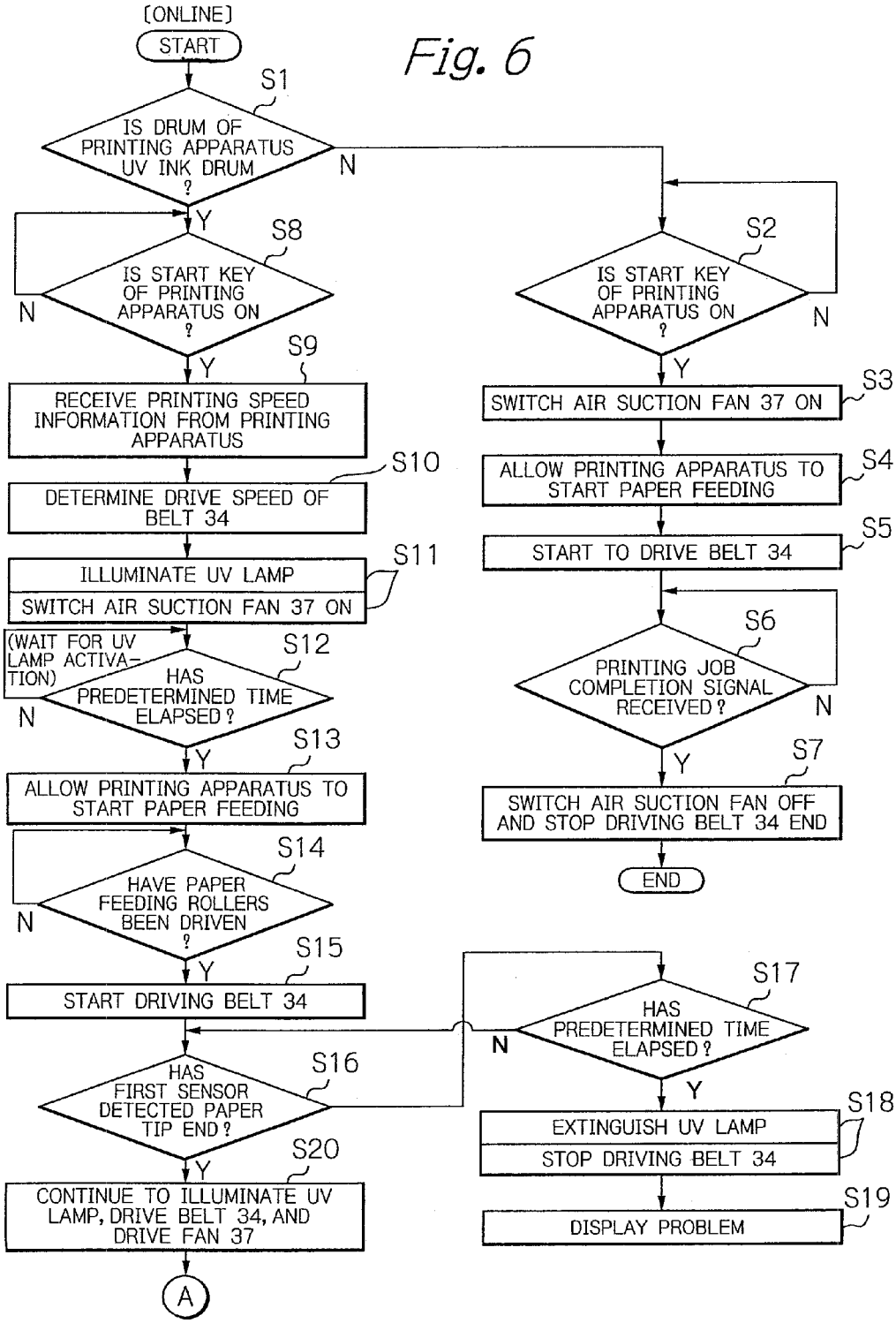
Fig. 6
[ONLINE]
START
S1
IS DRUM OF PRINTING APPARATUS UV INK DRUM ?
N
Y
S8
IS START KEY OF PRINTING APPARATUS ON ?
N
Y
S9
RECEIVE PRINTING SPEED INFORMATION FROM PRINTING APPARATUS
S10
DETERMINE DRIVE SPEED OF BELT 34
S11
ILLUMINATE UV LAMP
SWITCH AIR SUCTION FAN 37 ON
(WAIT FOR UV LAMP ACTIVATION)
S12
HAS PREDETERMINED TIME ELAPSED ?
N
Y
S13
ALLOW PRINTING APPARATUS TO START PAPER FEEDING
S14
HAVE PAPER FEEDING ROLLERS BEEN DRIVEN ?
N
Y
S15
START DRIVING BELT 34
S16
HAS FIRST SENSOR DETECTED PAPER TIP END ?
Y
S20
CONTINUE TO ILLUMINATE UV LAMP, DRIVE BELT 34, AND DRIVE FAN 37
A
S2
IS START KEY OF PRINTING APPARATUS ON ?
N
Y
S3
SWITCH AIR SUCTION FAN 37 ON
S4
ALLOW PRINTING APPARATUS TO START PAPER FEEDING
S5
START TO DRIVE BELT 34
S6
PRINTING JOB COMPLETION SIGNAL RECEIVED ?
N
Y
S7
SWITCH AIR SUCTION FAN OFF AND STOP DRIVING BELT 34 END
END
S17
HAS PREDETERMINED TIME ELAPSED ?
N
Y
S18
EXTINGUISH UV LAMP
STOP DRIVING BELT 34
S19
DISPLAY PROBLEM

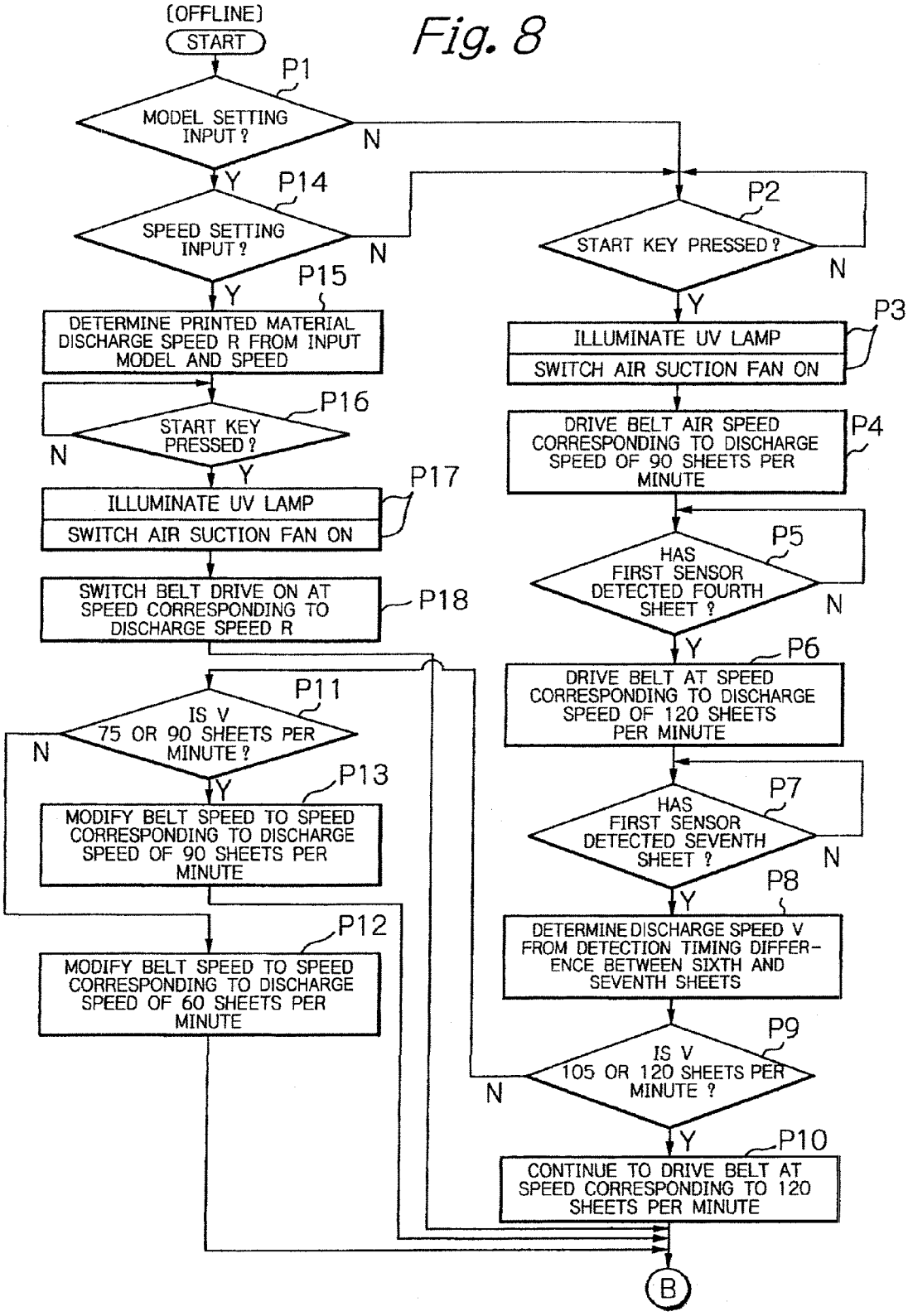
Fig. 8
(OFFLINE)
START
P1
MODEL SETTING INPUT ?
N
Y
P14
SPEED SETTING INPUT ?
N
Y
P15
DETERMINE PRINTED MATERIAL DISCHARGE SPEED R FROM INPUT MODEL AND SPEED
P16
START KEY PRESSED ?
N
Y
P17
ILLUMINATE UV LAMP
SWITCH AIR SUCTION FAN ON
P18
SWITCH BELT DRIVE ON AT SPEED CORRESPONDING TO DISCHARGE SPEED R
P11
IS V 75 OR 90 SHEETS PER MINUTE ?
N
Y
P13
MODIFY BELT SPEED TO SPEED CORRESPONDING TO DISCHARGE SPEED OF 90 SHEETS PER MINUTE
P12
MODIFY BELT SPEED TO SPEED CORRESPONDING TO DISCHARGE SPEED OF 60 SHEETS PER MINUTE
P2
START KEY PRESSED ?
N
Y
P3
ILLUMINATE UV LAMP
SWITCH AIR SUCTION FAN ON
P4
DRIVE BELT AIR SPEED CORRESPONDING TO DISCHARGE SPEED OF 90 SHEETS PER MINUTE
P5
HAS FIRST SENSOR DETECTED FOURTH SHEET ?
N
Y
P6
DRIVE BELT AT SPEED CORRESPONDING TO DISCHARGE SPEED OF 120 SHEETS PER MINUTE
P7
HAS FIRST SENSOR DETECTED SEVENTH SHEET ?
N
Y
P8
DETERMINE DISCHARGE SPEED V FROM DETECTION TIMING DIFFERENCE BETWEEN SIXTH AND SEVENTH SHEETS
P9
IS V 105 OR 120 SHEETS PER MINUTE ?
N
Y
P10
CONTINUE TO DRIVE BELT AT SPEED CORRESPONDING TO 120 SHEETS PER MINUTE
B

ULTRAVIOLET RAY IRRADIATION APPARATUS FOR FIXING PRINTED MATERIAL

BACKGROUND OF THE INVENTION

1. Field of the Invention

The present invention relates to an ultraviolet ray irradiation apparatus for fixing printed material, which is used while connected to a printed material discharge port of a printing apparatus employing ultraviolet curable ink (also known as UV curable ink) to irradiate an image surface of a printed material with ultraviolet rays, and more particularly to control of a printed material conveyance speed thereof.

2. Description of the Background Art

A stencil printer, for example, has low running costs and is capable of printing at high speed, and is therefore used widely for printing various printed materials, forms, and so on in educational institutions, public offices, organizations, hospitals, and soon. Stencil printers are also used for printing multiple copies of printed materials such as newspaper inserts, real estate publications, and in-house written communications in private enterprises. To ensure that the stencil printer can be operated easily by anybody at any time, a printing ink that does not harden in air is typically employed so that there is no need to clean the printing drum unit every time it is used. This stencil ink permeates the paper so as to give the appearance of being dry, but immediately after printing, the ink on printed material is not yet dry, and if this ink is touched, the printed image is easily spoiled. This has been identified as a serious problem in conventional stencil printing apparatuses, but no proposed measures have been implemented effectively.

A stencil printing apparatus that performs stencil printing using an ultraviolet curable ink and an ultraviolet ray irradiation apparatus for irradiating the printed material of the stencil printing apparatus with ultraviolet rays have been proposed as methods for improving the drying of printed material.

For example, Japanese Utility Model Publication H4-35188 relates to a stencil printing apparatus in which an ultraviolet ray irradiator is provided above a belt conveyor of a paper discharge apparatus. A cylindrical plate cylinder performs a single revolution during engraving in order to discharge a plate, but is stationary at all other times. Hence, at all times other than when the cylindrical plate cylinder position moves by a single revolution during engraving to discharge a plate, a solenoid is electrified and a movable slit plate is positioned in a shielding position shown in the drawings. As a result, ultraviolet rays issued by an ultraviolet lamp are prevented from exiting a lamp house.

Further, Japanese Unexamined Patent Application Publication H5-64878 relates to an ultraviolet fixing apparatus which irradiates a sheet of paper printed by printing means for performing printing using an ultraviolet curable ink with ultraviolet rays, thereby fixing the ink onto the printed paper. The ultraviolet fixing apparatus comprises paper conveyance means for conveying the printed paper separately to the printing means, and ultraviolet ray irradiating means provided above the paper conveyance means for irradiating the printed surface of the paper with ultraviolet rays. The upper portion or side portion of the paper conveyance means is open between the printing means and the ultraviolet ray irradiating means.

In a conventional stencil printing apparatus, an ultraviolet ray irradiation apparatus is disposed in connection with a paper discharge unit, and a printed material discharged therefrom is received and conveyed by the ultraviolet ray irradiation apparatus and then irradiated with ultraviolet rays to cure the image forming ink thereon.

Incidentally, in a printing apparatus, the printing speed may be selected variably, in contrast to an eletrophotographic copier, and therefore an operator sets an arbitrary printing speed. However, if the speed at which an ultraviolet ray irradiation apparatus connected directly to the printed material discharge unit of the printing apparatus receives and conveys the printed material is set at a fixed value, the printing speeds of the two apparatuses do not match, and as a result, a paper jam may occur around the connecting portion. If the paper jam occurs in close proximity to an ultraviolet ray irradiation unit, the ultraviolet ray irradiation time becomes abnormally long, and as a result, the ultraviolet lamp reaches a high temperature, causing excessive degeneration and deformation of the printing paper and a decrease in image quality.

In a printing apparatus, the printed material is delivered by the paper discharge unit and received by the reception unit of the ultraviolet ray irradiation apparatus, and hence it has conventionally been considered desirable to make the discharge speed of the paper discharge unit and the reception/conveyance speed of the ultraviolet ray irradiation apparatus reception unit identical. However, when the two speeds are made identical, the printed material may bend due to slippage caused by a slight speed difference and the effects of the paper type and paper size. Since the connecting portion is small, a bend in the paper is highly likely to create a paper jam.

Furthermore, the printing apparatus main body, to which the ultraviolet ray irradiation apparatus is connected, exists in a plurality of models, and the settable printing speeds and discharge speeds thereof may differ from each other. Hence, a technique for performing optimal control of an operation of the ultraviolet ray irradiation apparatus in accordance with this plurality of models is required.

SUMMARY OF THE INVENTION

An object of the present invention is to provide an ultraviolet ray irradiation apparatus capable of forestalling a printed material jam occurring between a paper discharge unit of a printing apparatus and a reception unit of the ultraviolet ray irradiation apparatus.

In an aspect of the present invention, an ultraviolet ray irradiation apparatus for fixing a printed material is connected to a printed material discharge port of a printing apparatus and comprises a belt type conveyance device configured to aspirate a lower surface of a discharged printed material and conveying the discharged printed material, a drive motor configured to drive said belt, a control device configured to control the driving of the belt, and an ultraviolet ray irradiation unit configured to irradiate an image surface of the discharged and conveyed printed material with ultraviolet rays. The ultraviolet ray irradiation apparatus has a signal line for exchanging electric signals with the printing apparatus, and performs control such that rotational driving of the belt drive motor of the ultraviolet ray irradiation apparatus is begun upon reception of a printing drum rotation start signal or a paper feeding unit paper conveyance start signal, and the belt driving is halted after a predetermined amount of time has elapsed following reception of a printing completion signal.

In another aspect of the present invention, an ultraviolet ray irradiation apparatus for fixing a printed material is connected to a printed material discharge port of a printing apparatus and comprises a belt type conveyance device configured to aspirate a lower surface of a discharged printed material and conveying the discharged printed material, a drive motor configured to drive the belt, a control device configured to control the driving of the belt, and an ultraviolet ray irradiation unit configured to irradiate an image surface of the discharged and conveyed printed material with ultraviolet rays. The ultraviolet ray irradiation apparatus has a signal line for exchanging electric signals with the printing apparatus, illuminates an ultraviolet lamp upon reception of a signal indicating that a print start command has been issued on the printing apparatus side, and when a predetermined amount of time has elapsed therefrom, transmits a signal to the printing apparatus side allowing rotation of a printing drum of the printing apparatus and paper conveyance by a paper feeding unit to begin.

In another aspect of the present invention, an ultraviolet ray irradiation apparatus for fixing a printed material is connected to a printed material discharge port of a printing apparatus and comprises a belt type conveyance device configured to aspirate a lower surface of a discharged printed material and conveying the discharged printed material, a drive motor configured to drive the belt, a control device configured to control the driving of the belt, and an ultraviolet ray irradiation unit configured to irradiate an image surface of the discharged and conveyed printed material with ultraviolet rays. The ultraviolet ray irradiation apparatus receives information relating to a discharge speed of a printed material discharge device in the connected printing apparatus from a control device on the printing apparatus side, and controls the drive motor of the belt type conveyance device in the ultraviolet ray irradiation apparatus to rotate at a higher speed than the discharge speed of the printed material discharge device.

In another aspect of the present invention, an ultraviolet ray irradiation apparatus for fixing a printed material is connected to a printed material discharge port of a printing apparatus and comprises a belt type conveyance device configured to aspirate a lower surface of a discharged printed material and conveying the discharged printed material, a drive motor configured to drive the belt, a control device configured to control the driving of the belt, and an ultraviolet ray irradiation unit for irradiating an image surface of the discharged and conveyed printed material with ultraviolet rays. The ultraviolet ray irradiation apparatus is provided with a sensor for detecting a tip end of the printed material discharged to the vicinity of a printed material reception unit of the ultraviolet ray irradiation apparatus, determines a time difference between a timing at which the sensor detects the arrival of the tip end of the printed material and a timing at which the sensor detects the arrival of a tip end of a following printed material, determines a printed material discharge speed of the printing apparatus from a value thereof, and controls the drive motor of the belt type conveyance device in the ultraviolet ray irradiation apparatus to a higher speed than the discharge speed of the printed material discharge device.

In another aspect of the present invention, an ultraviolet ray irradiation apparatus for fixing a printed material is connected to a printed material discharge port of a printing apparatus and comprises a belt type conveyance device configured to aspirate a lower surface of a discharged printed material and conveying the discharged printed material, a drive motor configured to drive the belt, a control device configured to control the driving of the belt, and an ultraviolet ray irradiation unit configured to irradiate an image surface of the discharged and conveyed printed material with ultraviolet rays. The ultraviolet ray irradiation apparatus is provided with an operating panel unit on which a value of a set printing speed during printing in the connected printing apparatus is input, and a control device of the ultraviolet ray irradiation apparatus determines a printed material discharge speed from input printing speed information and controls the drive motor of the belt type conveyance device of the ultraviolet ray irradiation apparatus to a higher speed than a discharge speed of a printed material discharge device.

BRIEF DESCRIPTION OF THE DRAWINGS

The above and other objects, features, and advantages of the present invention will become more apparent from the following detailed description taken with the accompanying drawings, in which:

FIG. 6 is a view showing a part of a flowchart executed when the control system of the ultraviolet ray irradiation apparatus is online;

FIG. 8 is a view showing a part of a flowchart executed when the control system of the ultraviolet ray irradiation apparatus is offline.

DESCRIPTION OF THE PREFERRED EMBODIMENTS

Embodiments of the present invention will be described in detail below with reference to the drawings.

[1] First Embodiment

Figure 1:
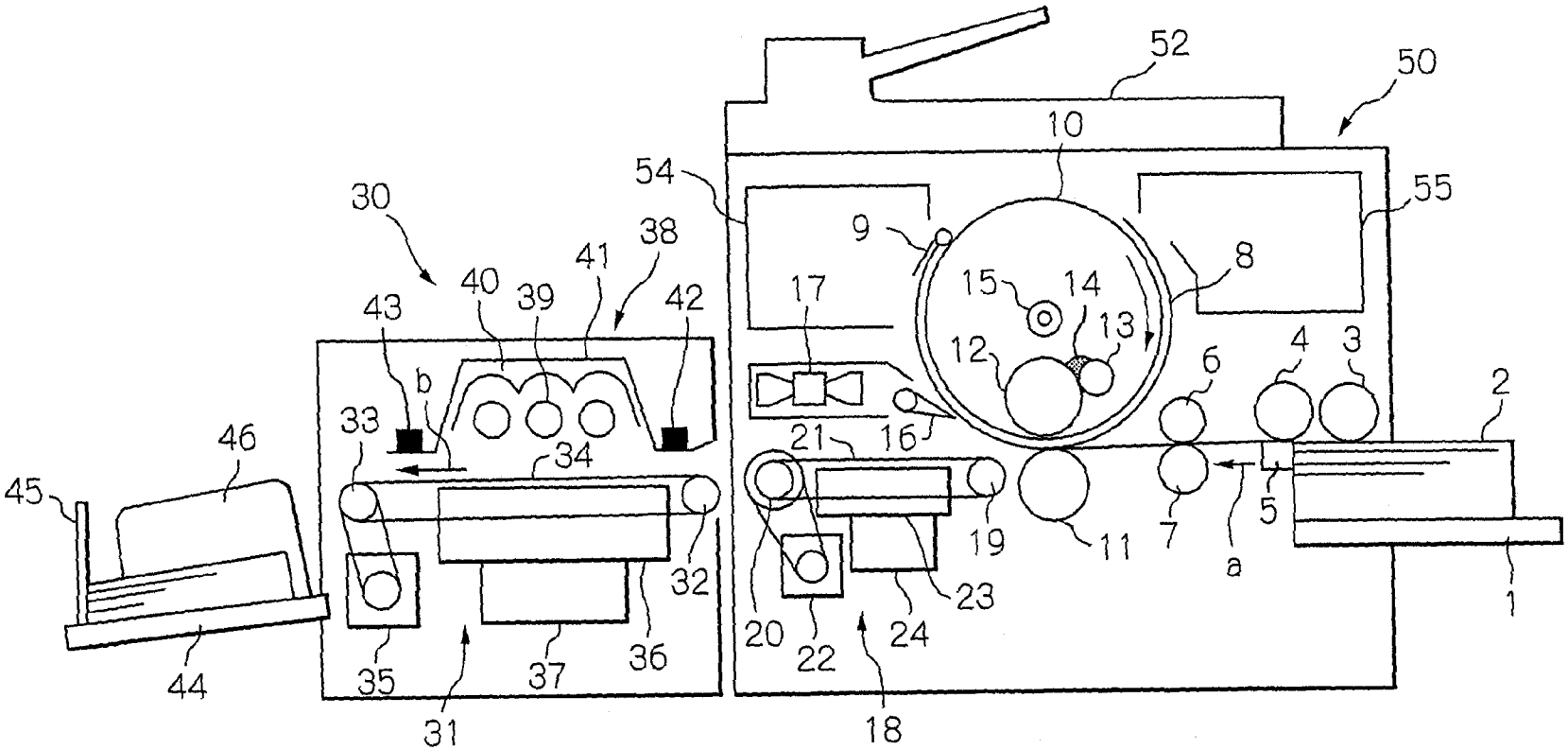
FIG. 1 is a view showing the schematic constitution of an ultraviolet ray irradiation apparatus and a stencil printing apparatus according to the present invention.

FIG. 1 shows the schematic constitution of an ultraviolet ray irradiation apparatus according to the present invention and a stencil printing apparatus to which the ultraviolet ray irradiation apparatus is connected.

A stencil printing apparatus 50 comprises a call-up roller 3, a separating roller 4, and a separating pad 5 for separating printing paper (also referred to as printed material hereafter) 2 stacked on a paper feeding table 1 into single sheets and conveying the printing paper 2 toward a resist roller pair. The resist roller pair (constituted by an upper resist roller 6 and a lower resist roller 7), which conveys the single sheet of printing paper separated in the manner described above to a stencil printing unit at a predetermined timing, is provided downstream of the separating pad 5, as shown by an arrow a.

Once the printing paper has been issued from the resist roller pair at the predetermined timing, an engraved stencil base paper 8 latches the tip end thereof using a base paper damper 9 such that the printing paper is guided by a guide plate, not shown in the drawing, and conveyed toward the stencil printing unit between a printing drum, which is wrapped around and attached to the outer periphery of a cylindrical plate cylinder 10, and a press roller 11, which rotates while pressing the printing paper against the printing drum. The printing drum is driven to rotate in the direction of an arrow in the drawing by a driving mechanism, not shown in the drawing.

The interior of the cylindrical plate cylinder 10 comprises an ink roller 12 that is driven to rotate, a doctor roller 13 disposed diagonally above the ink roller 12, an ink reservoir 14 formed from a substantially wedge-shaped gap between the ink roller 12 and doctor roller 13, and so on. Ultraviolet curable printing ink is supplied toward the ink reservoir 14 through an ink supply pipe 15. The ink is supplied to the inner surface of the cylindrical plate cylinder 10, which has a large number of openings, passes through these openings, passes through engraving hole portions in the stencil base paper, and is thus transferred onto the surface of the printing paper. As a result, a printed image is formed by the ultraviolet curable printing ink.

The printing paper subjected to stencil printing is peeled away from the stencil base paper by a peeling pawl 16 and air pressure from an air discharge fan 17, and conveyed in the leftward direction of the drawing by a paper discharge conveyance apparatus 18. Here, the paper discharge conveyance apparatus 18 comprises a plurality of endless belts 21 wrapped around a front roller 19 and a rear roller 20, a drive motor 22 for driving the endless belts 21 to rotate by rotating the rear roller 20, and an air suction duct 23 and an air suction fan 24 for aspirating the rear surface of the printing paper so that the rear surface of the printing paper contacts the conveyor belt.

A printed material discharge port of the stencil printing apparatus 50 is formed beyond the left end of the endless belt 21, and a right end opening portion of an ultraviolet ray irradiation apparatus 30 is connected to the printed matter discharge port. Thus, the ultraviolet ray irradiation apparatus 30 is connected so as to be capable of conveying printing paper delivered from the paper discharge conveyance apparatus 18 of the stencil printing apparatus 50. The ultraviolet ray irradiation apparatus 30 comprises a belt type printed material conveyance apparatus 31 for conveying printed material received from the right end opening portion. The printed material conveyance apparatus 31 comprises a dedicated drive motor 35 for driving a plurality of perforated endless belts 34 made of thin metal plates and wrapped around a front roller 32 and a rear roller 33, and an air suction duct 36 and an air suction fan 37 for aspirating the lower surface (rear surface) of the printing paper, which is on the opposite side to the upper surface, i.e. the printed surface, to bring the lower surface of the printing paper into contact with the perforated endless belts 34. The drive motor 35 is connected to the rear roller 33 via a belt, and is controlled by a control apparatus 62 to be described below.

An ultraviolet ray irradiation portion, or more specifically an ultraviolet ray irradiation unit 38, is provided above the printed material conveyance apparatus 31 for irradiating the image surface of the printing paper with ultraviolet rays after the printing paper has been discharged from the stencil printing apparatus 50 and conveyed by the perforated endless belt 34. The ultraviolet ray irradiation unit 38 comprises an ultraviolet lamp 39 such as a high pressure mercury lamp, a metal halide lamp, or an amalgam lamp, a reflector 40 formed from an aluminum plate or the like, and a cover casing 41 provided on the outside of the reflector 40. Although not shown in the drawing, the ultraviolet ray irradiation unit 38 also comprises an air discharge pipe, a suction fan, and so on for aspirating the air in the cover casing 41 and discharging the air to the exterior of the printing apparatus after passing the air through an ozone filter.

Further, a first sensor 42 for detecting the passage of the printing paper is provided at the front end portion of ultraviolet ray irradiation, and a second sensor 43 is provided at the rear end portion of ultraviolet ray irradiation. More specifically, the first sensor 42 is an optical reflection sensor disposed within the irradiation range of the ultraviolet ray irradiation unit 38 on the outside and to the front of the conveyance direction of the casing 41, and is used to detect the tip end of the printed material discharged to the vicinity of the printed material reception unit of the ultraviolet ray irradiation apparatus 30. Meanwhile, the second sensor 43 is disposed within the irradiation range of the ultraviolet ray irradiation unit 38 on the outside and to the rear of the conveyance direction of the cover casing 41, which is indicated by an arrow b.

The printing paper conveyed by the printed material conveyance apparatus 31 is irradiated with ultraviolet rays, and as a result, the ink on the image surface thereof is cured and fixed. The printed material is then stacked and stored on a paper discharge tray 44. The tip end portion of the discharged paper is stopped by an end fence 45, while the two side faces of the discharged paper are guided and positioned by a side fence 46.

Figure 2:
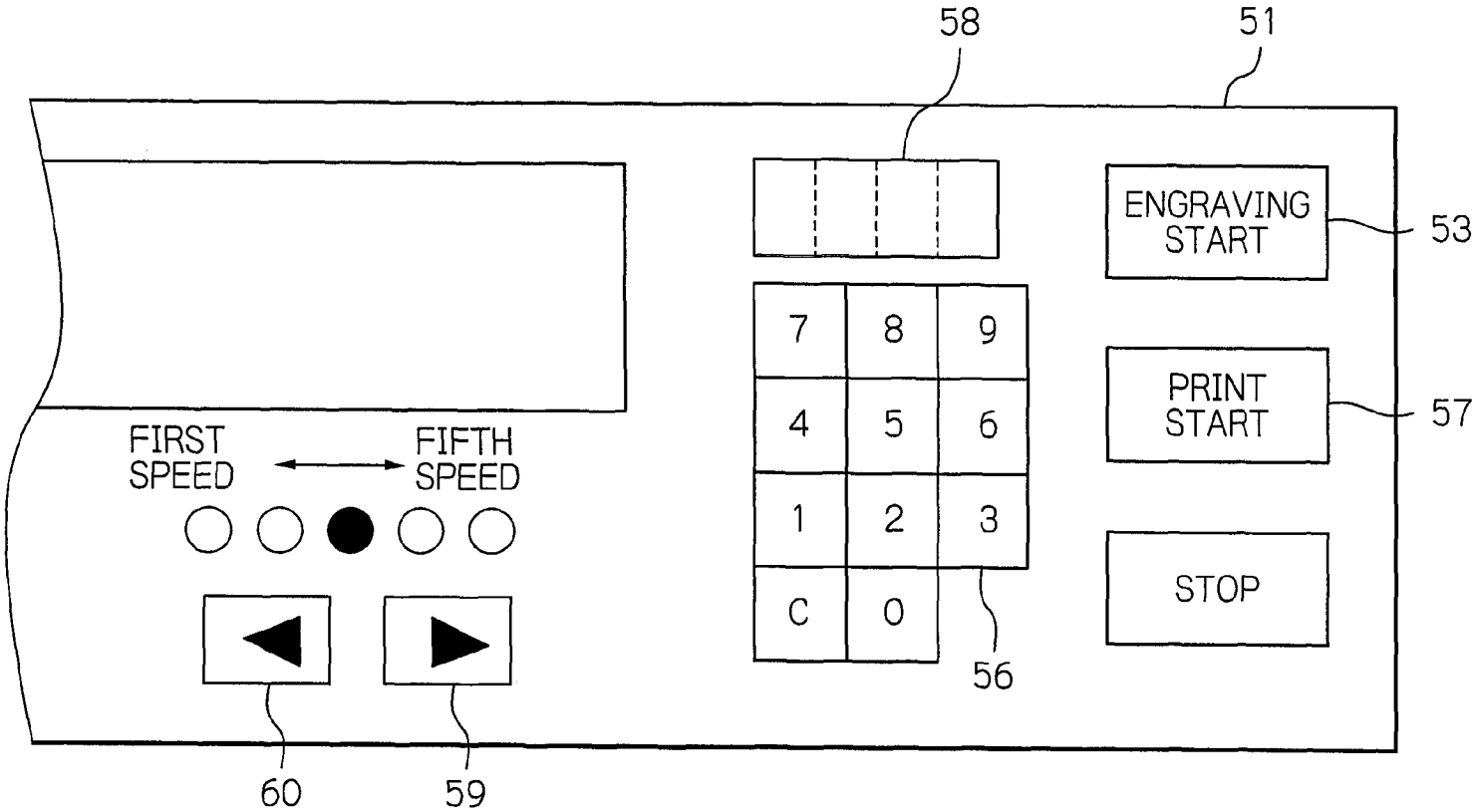
FIG. 2 is a front view showing a part of an operating panel of the stencil printing apparatus.

FIG. 2 shows an operating panel 51 of the stencil printing apparatus 50. In the following description, FIG. 1 will be referenced where necessary. When an original is set on an original reading apparatus 52, the interior details of which have been omitted from the drawing, and an engraving start key 53 in FIG. 2 is pressed, a used base paper wrapped around the outer periphery of the cylindrical plate cylinder 10 constituting the main part of the printing drum is peeled away from the cylindrical plate cylinder 10 by a plate discharge apparatus 54, the interior details of which have been omitted from the drawing, conveyed to a discharged plate storage box in the interior of the plate discharge apparatus 54, and stored therein. Simultaneously, the original reading apparatus 52 reads the original optically and converts the read original into an electric signal, whereupon an engraving apparatus 55, the interior details of which have been omitted from the drawing, engraves an image by punching holes into the stencil base paper in accordance with the image information of the original, and then conveys the engraved stencil base paper such that the engraved base paper is wrapped around and attached to the outer periphery of the cylindrical plate cylinder 10.

Next, the required number of printed sheets is input using a numeric keypad 56, and a print start key 57 is pressed. As a result, the printing drum is driven to rotate, and substantially simultaneously, the call-up roller 3 and separating roller 4 of the paper feeding unit are also driven to rotate, whereby feeding and conveyance of the printing paper begins. The input number of printed sheets is displayed on a display unit 58.

A speed instruction key 59 and a speed instruction key 60 for inputting a printing speed are provided on the operating panel 51 of the stencil printing apparatus 50, and an operator indicates the required printing speed here. The printing speed may be selected from five speeds, namely a first speed to a fifth speed, and the third speed is typically selected automatically as a standard speed when the power is switched ON.

When a higher speed than the third speed is required, the fourth speed or fifth speed is selected by pressing the key 59, and when a lower speed is required, the first speed or second speed is selected by pressing the key 60. Specifically, for example, the first speed is 60 sheets per minute, the third speed is 90 sheets per minute, and the fifth speed is 120 sheets per minute.

Figure 3:
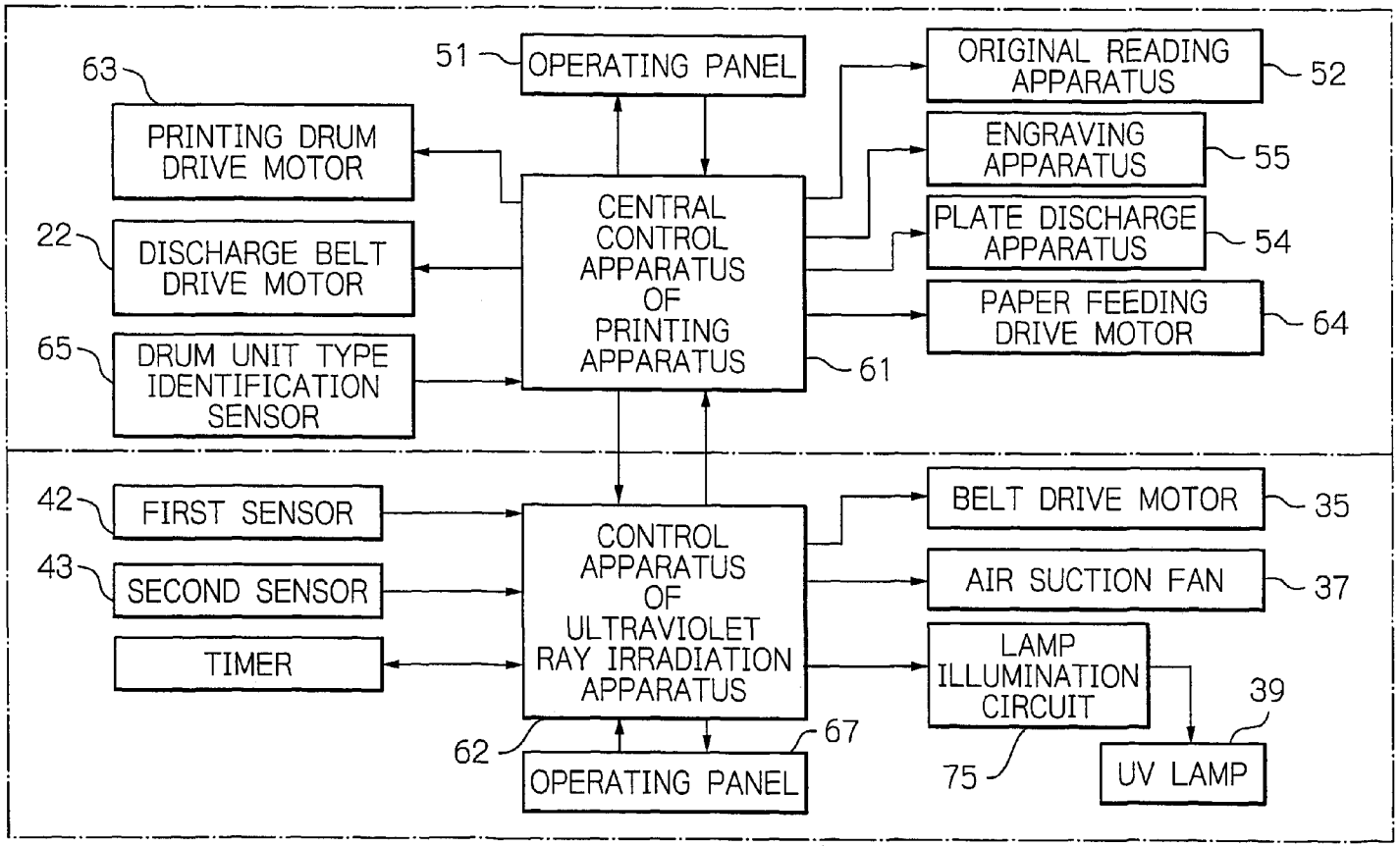
FIG. 3 is a block diagram showing the constitution of a control system of the ultraviolet ray irradiation apparatus and stencil printing apparatus.

FIG. 3 shows control-related constitutions of the stencil printing apparatus 50 and ultraviolet ray irradiation apparatus 30. In the first embodiment, a central control apparatus 61 of the stencil printing apparatus 50 is constituted to be capable of exchanging required information and instructions with a control apparatus 62 of the ultraviolet ray irradiation apparatus 30 connected to the printed material discharge unit.

The stencil printing apparatus 50 comprises a drum unit type identification sensor (to be referred to hereafter as a sensor 65) for detecting the type of a printing drum unit constituted by the cylindrical plate cylinder 10 and auxiliary members thereof, which can be attached to and detached from the stencil printing apparatus 50. Using the sensor 65, it is possible to identify whether or not the attached printing drum unit uses ultraviolet curable ink. When the printing drum unit attached to the stencil printing apparatus 50 uses ultraviolet curable ink, the control apparatus 62 of the ultraviolet ray irradiation apparatus 30 receives information indicating that the print start key 57 disposed on the operating panel 51 of the stencil printing apparatus 50 has been pressed, or in other words a signal indicating that a print start command has been issued on the printing apparatus side, and immediately illuminates the ultraviolet lamp 39 by switching an ultraviolet lamp illumination circuit ON and begins an air suction operation by driving the air suction fan 37. Once a predetermined amount of time has elapsed following illumination of the ultraviolet lamp 39, the control apparatus 62 transmits signals permitting the start of rotation of the printing drum of the printing apparatus and the start of paper conveyance by the paper feeding unit to the central control apparatus 61.

Hence, when the print start key 57 is pressed, a printing drum rotation start signal and a paper feeding unit paper conveyance start signal are generated by the central control apparatus 61, and as a result, the printing drum begins to rotate and the rollers of the paper feeding unit, including the call-up roller 3 and separating roller 4, are driven. By transmitting the printing drum rotation start signal or the paper feeding unit paper conveyance start signal to the control apparatus 62 over a signal line, the control apparatus 62 starts to drive the drive motor 35 to rotate at substantially the same time as it receives the printing drum rotation start signal or paper feeding unit paper conveyance start signal.

When printing of the predetermined number of sheets is complete, the central control apparatus 61 generates a printing completion signal, and the printing completion signal is transmitted to the control apparatus 62 over a signal line and received thereby. Then, after a predetermined time, such as the time required to discharge the final sheet of printing paper to the paper discharge tray 44, has elapsed, the control apparatus 62 halts rotation of the drive motor 35.

Thus, the belt drive start timing and drive end timing can be optimized in relation to the printing apparatus, and since the belt is not driven when not required, low noise and low power consumption can be achieved. However, the belt is driven as soon as printed material conveyance begins, and when printing ends, the belt is not stopped until the printed material has passed securely through the paper discharge process. Therefore, the conveyance quality can be kept high.

Furthermore, signals permitting the start of rotation of the printing drum in the printing apparatus and the start of paper conveyance by the paper feeding unit are transmitted to the central control apparatus 61 once a predetermined time has elapsed following illumination of the ultraviolet lamp 39, and therefore a situation in which printing is started immediately after the ultraviolet lamp is illuminated such that the printed material passes through the ultraviolet ray irradiation apparatus 30 during lamp activation, when the light emission energy is insufficient, thereby causing a curing deficiency, can be prevented. Accordingly, the problem of insufficient curing during the initial stage of ultraviolet lamp illumination following activation thereof can be solved. Note that when the engraving start key is pressed, the lamp can be illuminated during the engraving period, and therefore this problem does not arise.

However, a small amount of time is required for the output of the ultraviolet lamp 39 to reach a normal value, and therefore the control apparatus 62 measures the waiting time using a timer provided therein. When the output of the ultraviolet lamp 39 reaches the normal value, the control apparatus 62 transmits an air suction operation start OK signal to the central control apparatus 61 of the stencil printing apparatus 50. The waiting time differs according to the type of lamp, but extends from approximately one minute to approximately ten or more minutes.

Having received the air suction operation start OK signal, the central control apparatus 61 of the stencil printing apparatus 50 transmits a drive start signal to a printing drum rotation drive motor 63, and then transmits a drive start signal to the paper feeding drive motor 64 for driving the call-up roller 3 and separating roller 4 of the paper feeding unit to rotate. Simultaneously, printing drum rotation start information or paper feeding start information is transmitted to the control apparatus 62 of the ultraviolet ray irradiation apparatus 30.

Upon reception of this information, the control apparatus 62 immediately begins rotational driving of the drive motor 35 for driving the perforated endless belt 34 to rotate. As a result, the printing paper is conveyed by the paper feeding operation, image formation printing using ultraviolet curable ink is performed by the plate discharge and printing units, the printed material is conveyed further to undergo ultraviolet ray irradiation in the interior of the ultraviolet ray irradiation apparatus 30, whereby the printed image is dried and fixed, and the printed material is discharged, stacked on the paper discharge tray 44, and stored.

The central control apparatus 61 of the stencil printing apparatus 50 specifies the rotation speed of the drive motor 22 for driving the endless belt 21 of the paper discharge conveyance apparatus 18 to rotate in accordance with the printing speed input using the speed instruction keys 59, 60.

Further, the central control apparatus 61 transmits information regarding the input printing speed or information regarding the rotation speed of the drive motor 22 to the control apparatus 62 of the ultraviolet ray irradiation apparatus 30. The control apparatus 62 can learn the printed material discharge speed from this information, and therefore rotationally drives the drive motor 35 to rotate the perforated endless belt 34 at a speed set slightly higher than the printed material discharge speed.

Hence, even when speed setting on the printing apparatus side is arbitrarily variable, the ultraviolet ray irradiation apparatus side can be driven at an optimum belt conveyance speed corresponding thereto. As a result, sufficient ultraviolet curing can be achieved, and jams occurring due to mismatched conveyance speeds can be prevented.

This will now be described in further detail.

The central control apparatus 61 of the stencil printing apparatus 50 drives the printing drum to rotate at the instructed printing speed, and simultaneously instructs rotational driving of the drive motor 22 at a predetermined speed so that the endless belt 21 of the paper discharge conveyance apparatus 18 are driven to rotate at an optimum speed corresponding to the printing drum rotation speed. In this case, the surface movement speed of the endless belt 21 is set in accordance with the speed of the printing drum outer periphery.

For example, the surface movement speed of the endless belt 21 is 70 cm per second in the first speed, 105 cm per second in the third speed, and 140 cm per second in the fifth speed. The central control apparatus 61 of the stencil printing apparatus 50 transmits information regarding the instructed printing speed as is to the control apparatus 62 of the ultraviolet ray irradiation apparatus 30 over a signal line. Alternatively, information regarding the rotation speed of the drive motor 22 or information regarding the surface movement speed of the endless belt 21 is transmitted to the control apparatus 62 of the ultraviolet ray irradiation apparatus 30 over a signal line. The signal line is a line for exchanging electric signals between the central control apparatus 61 and control apparatus 62, and, as shown by the bi-directional arrows linking the central control apparatus 61 and control apparatus 62 in FIG. 3, this information is exchanged over the signal line.

The control apparatus 62 of the ultraviolet ray irradiation apparatus 30 accesses or calculates discharge speed data relating to the corresponding printed material from the received printing speed information or endless belt surface movement speed information, and drives the drive motor 35 to rotate such that the surface movement speed of the perforated endless belt 34 in the printed material conveyance apparatus 31 is slightly higher than the printed material discharge speed. Incidentally, the printed material discharge speed and the surface speed of the endless belt 21 need not be identical.

For example, the drive motor 35 is driven to rotate such that the surface movement speed of the perforated endless belt 34 is 10% higher than the printed material discharge speed, or more specifically 77 cm per second in the first speed, 116 cm per second in the third speed, and 154 cm per second in the fifth speed. When the surface movement speed of the perforated endless belt 34 in the printed material conveyance apparatus 31 and the surface movement speed of the endless belt 21 in the paper discharge conveyance apparatus 18 are identical, a slight slip, a speed irregularity, and so on cause a bend to form in the printed matter between the two apparatuses, and therefore the surface movement speed of the perforated endless belt 34 is sets lightly higher than the printed material discharge speed to prevent this. In a suction belt conveyance system, the paper may slip relative to the belt speed, causing a slight delay. The amount of slippage varies according to conditions, but it has been learned through experiment and the like that by making the surface movement speed of the perforated endless belt 34 at least 5% higher than the printed material discharge speed, this delay can be corrected.

By ensuring that the surface movement speed of the perforated endless belt 34 in the printed material conveyance apparatus 31 is set higher than the surface movement speed of the endless belt 21 in the paper discharge conveyance apparatus 18, jams caused by bends in the paper can be prevented more reliably. This speed setting is performed in an identical manner in the other embodiments to be described below.

On the other hand, if the surface movement speed of the perforated endless belt 34 in the printed material conveyance apparatus 31 is set excessively high, the printed material moves beneath the ultraviolet ray irradiation unit 38 at a high speed and in a short amount of time such that the total amount of energy released onto the ink of the printed image through ultraviolet ray irradiation decreases. As a result, sufficient curing cannot be achieved. When the surface movement speed of the perforated endless belt 34 is set 20% higher than the printed material discharge speed, the ink on the image surface can barely be cured during printing in the fifth speed, and therefore this numerical value is set as an upper limit. As noted above, the lower limit is preferably set at an increase of 5% in consideration of paper slippage.

In FIG. 1, the first sensor 42 for detecting passage of the printing paper is provided at the front end portion of ultraviolet ray irradiation. The first sensor 42 is capable of detecting the timing at which the printed material is discharged from the stencil printing apparatus 50. When the print start key 57 has been pressed and continuous printed material discharge is underway, the control apparatus 62 of the ultraviolet ray irradiation apparatus 30 detects the printed material discharge timing from the stencil printing apparatus 50 constantly using the first sensor 42.

Usually, when a paper conveyance jam occurs in the stencil printing apparatus 50, information relating thereto is transmitted to the control apparatus 62 of the ultraviolet ray irradiation apparatus 30, and in so doing, a slight time deviation occurs. At such a time, it is necessary for the control apparatus 62 of the ultraviolet ray irradiation apparatus 30 to detect the problem in the stencil printing apparatus using the first sensor 42 as early as possible.

The first sensor 42 detects every printed material discharge, and therefore, when the first sensor 42 does not detect the next printed material after a predetermined time (a required conveyance time from an arbitrary reference position to the first sensor 42, which is determined from the printed material conveyance speed and conveyance distance) has elapsed relative to a timing interval set therein, it is determined that a problem has occurred on the stencil printing apparatus 50 side. In this case, the control apparatus 62 immediately extinguishes the ultraviolet lamp 39 and halts rotation of the drive motor 35. In the third printing speed, for example, printed material is detected once every 0.67 seconds.

However, when printed material is suddenly not detected for twice that time, i.e. 1.3 seconds, it is determined that a problem has occurred. A problem can be predicted more quickly using this detection than using a trouble signal transmitted by the stencil printing apparatus 50. When a single printing job is complete, the central control apparatus 61 of the stencil printing apparatus 50 transmits a printing job completion signal to the control apparatus 62 of the ultraviolet ray irradiation apparatus 30.

Upon reception of this signal, the control apparatus 62 extinguishes the ultraviolet lamp 39 and halts rotation of the drive motor 35. However, a predetermined time difference is provided in this process, and therefore the control apparatus 62 extinguishes the ultraviolet lamp 39 and halts rotation of the drive motor 35 after a slight delay.

[2] Second Embodiment

The second embodiment relates to a case in which the control apparatus 62 of the ultraviolet ray irradiation apparatus 30 is incapable of exchanging information with the central control apparatus 61 of the stencil printing apparatus 50 online. The first sensor 42 is capable of detecting each discharge of printed material from the stencil printing apparatus 50, and therefore the printed material discharge speed must be detected using the detection of the first sensor 42.

A time difference is set between the timing at which the first sensor 42 detects the arrival of the tip end of a printed material and the timing at which the first sensor 42 detects the arrival of the tip end of the next printed material, and the printed material discharge speed of the stencil printing apparatus 50 is determined from the value of this time difference. However, it must be noted that at the start of printing, the printing speed does not reach the set value immediately, but increases in steps. Hence, measures must be taken in recognition of the fact that the printing speed increases gradually over the first few sheets of printing paper, and the set printing speed must be determined after a predetermined number of sheets have been detected.

Figure 4:
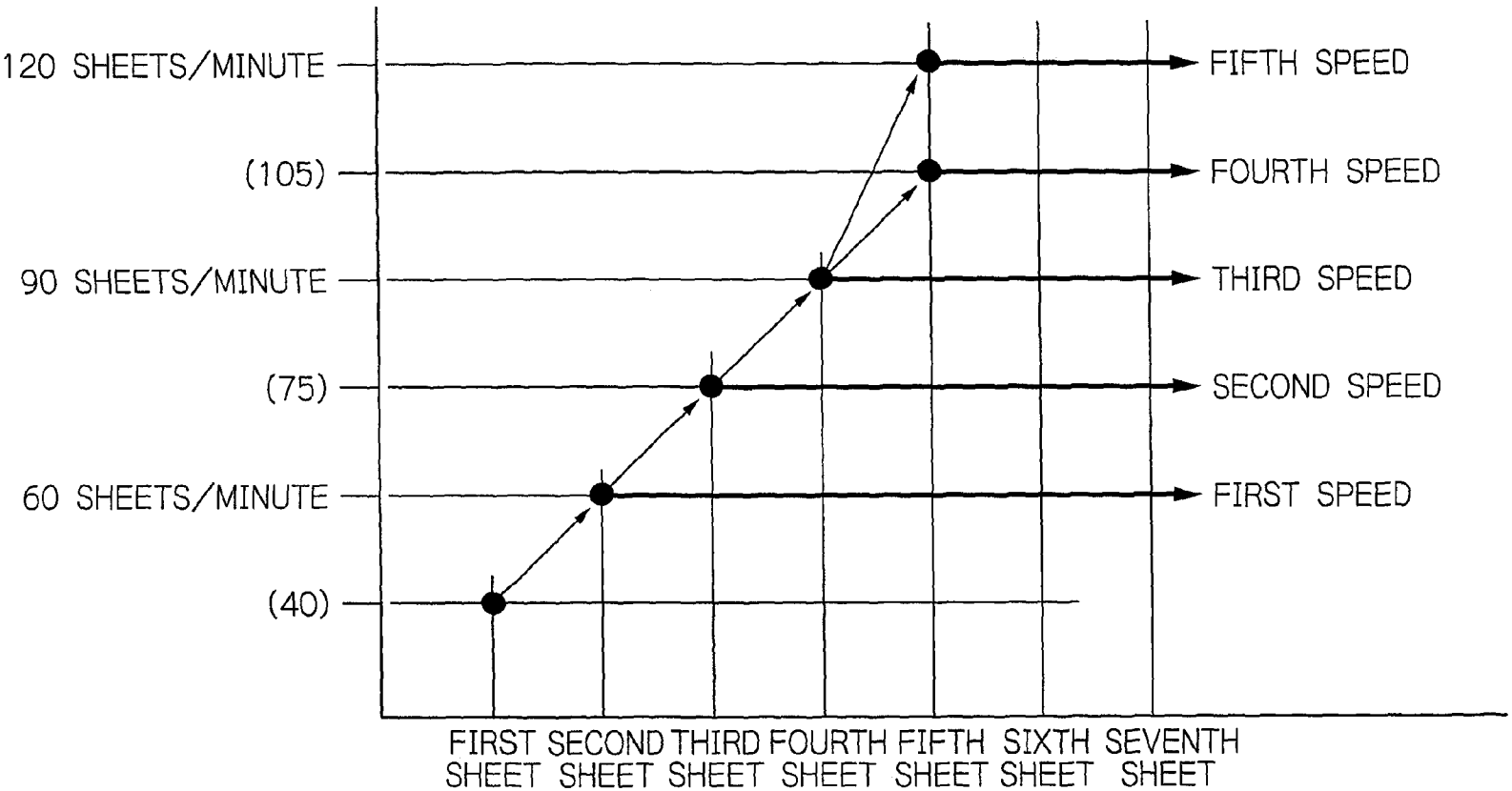
FIG. 4 is a graph showing variation in a printing speed increase at the start of printing in the stencil printing apparatus.

FIG. 4 is a graph showing variation in the printing speed increase at the start of printing in the stencil printing apparatus 50.

For example, printing is performed on the first sheet at a low speed of 40 sheets per minute since image printing has barely begun. When the second sheet is printed, the speed increases to 60 sheets per minute, and if the set speed is the first speed, printing continues thereafter at 60 sheets per minute. Hence, if the time difference in the timing at which the first sensor 42 detect the arrival of the printed material tip end still corresponds to 60 sheets per minute at the fourth sheet, the control apparatus 62 can determine that the set speed is the first speed.

When the set speed is the third speed, the third sheet is printed at 75 sheets per minute, the fourth sheet is printed at 90 sheets per minute, and thereafter, printing continues at 90 sheets per minute. Hence, if the time difference in the timing at which the first sensor 42 detect the arrival of the printed material tip end still corresponds to 90 sheets per minute at the sixth sheet, the control apparatus 62 can determine that the set speed is the third speed.

When the set speed is the fifth speed, the fourth sheet is printed at 90 sheets per minute, the fifth sheet is printed at 120 sheets per minute, and thereafter, printing continues at 120 sheets per minute. Hence, if the time difference in the timing at which the first sensor 42 detect the arrival of the printed material tip end corresponds to 120 sheets per minute from the sixth sheet onward, the control apparatus 62 can determine that the set speed is the fifth speed.

Needless to say, the drive motor 35 is rotationally driven in accordance with the printed material discharge speed, determined in the manner described above, to rotate the perforated endless belt 34 at a speed set slightly higher than the printed material discharge speed.

According to this embodiment, the speed at which the printed material is discharged from the stencil printing apparatus can be detected even in an offline state, in which the ultraviolet ray irradiation apparatus is not electrically connected to the stencil printing apparatus, and the ultraviolet ray irradiation apparatus side can be driven at an optimum belt conveyance speed corresponding to the printed material discharge speed. Hence, insufficient ultraviolet curing due to an excessively high speed can be eliminated, and jams caused by bends in the printing paper due to an insufficient conveyance speed can be prevented.

[3] Third Embodiment

To reduce the likelihood of a jam as much as possible from the start of printing using a simpler method than the method described above, the perforated endless belt 34 is driven to rotate at a speed corresponding to the maximum speed of the stencil printing apparatus 50, or in other words a speed corresponding to the printed material discharge speed at the maximum printing speed of the stencil printing apparatus, at the start of printing. A time difference in the printed material tip end arrival timing between a predetermined sheet following the start of printing and the next sheet, for example the time difference in the timing at which the first sensor 42 detects the arrival of the printed material tip end from the fifth sheet to the seventh sheet following the start of printed material detection, is then detected, and the set printing speed or the printed material discharge speed is calculated from the value thereof. Thereafter, the perforated endless belt 34 of the ultraviolet ray irradiation apparatus 30 is driven to rotate constantly at a slightly higher speed than the printed material discharge speed. This method is possible because, regardless of the speed variation at the start, the set printing speed is reached at a predetermined sheet (in this embodiment, from the fifth to the seventh sheet following the start of printed material detection).

When the control apparatus 62 of the ultraviolet ray irradiation apparatus 30 is unable to exchange information with the central control apparatus 61 of the stencil printing apparatus 50 online, jams occurring both during printing and after the completion of printing must be detected by the first sensor 42.

The first sensor 42 detects every printed material discharge, and therefore, when the first sensor 42 does not detect the next printed material after a predetermined time has elapsed relative to a set timing interval, it is determined that either a problem has occurred on the printing apparatus side or printing is complete. In either case, the control apparatus 62 extinguishes the ultraviolet lamp 39* and halts rotation of the drive motor 35.

[4] Fourth Embodiment

Normally, the printing speed of the stencil printing apparatus 50 is preset at the standard speed, and when no specific instruction is issued, printing is begun at this standard speed. Hence, when no specific instruction has been input, the control apparatus 62 of the ultraviolet ray irradiation apparatus 30 controls the rotation speed of the drive motor 22 in the belt type printed material conveyance apparatus 31 of the ultraviolet ray irradiation apparatus 30 to a slightly higher speed than the printed material discharge speed, which is determined from the standard printing speed of the stencil printing apparatus 50, using this printed material discharge speed as a reference.

Therefore, in an offline state where the ultraviolet ray irradiation apparatus is not electrically connected to the printing apparatus, the speed of the connected printing apparatus can be predicted stochastically without the need to input the model and set printing speed of the connected printing apparatus one by one, and as a result, jams can be prevented from occurring at the initial stage of printing. Further, by calculating the set printing speed or printed material discharge speed from the time difference in the printed material tip end arrival timing while printing is underway, the ultraviolet ray irradiation apparatus side can be driven thereafter at an optimum belt conveyance speed corresponding to the printed material discharge speed. As a result, insufficient ultraviolet curing due to excessive speed can be eliminated, and jams caused by bends in the printing paper due to an insufficient conveyance speed can be prevented.

Needless to say, the time difference in the timing at which the first sensor 42 detects the arrival of the printed material tip end from the fifth sheet to the seventh sheet following the start of printed material detection is detected, the set printing speed is determined from the value thereof, and thereafter, the printing speed is determined according to the determination result. As regards speed variation at the start, it is more effective to determine that the printing speed is the standard third speed than the fifth speed in terms of curing the printed material using ultraviolet ray irradiation[i].

Figure 5:
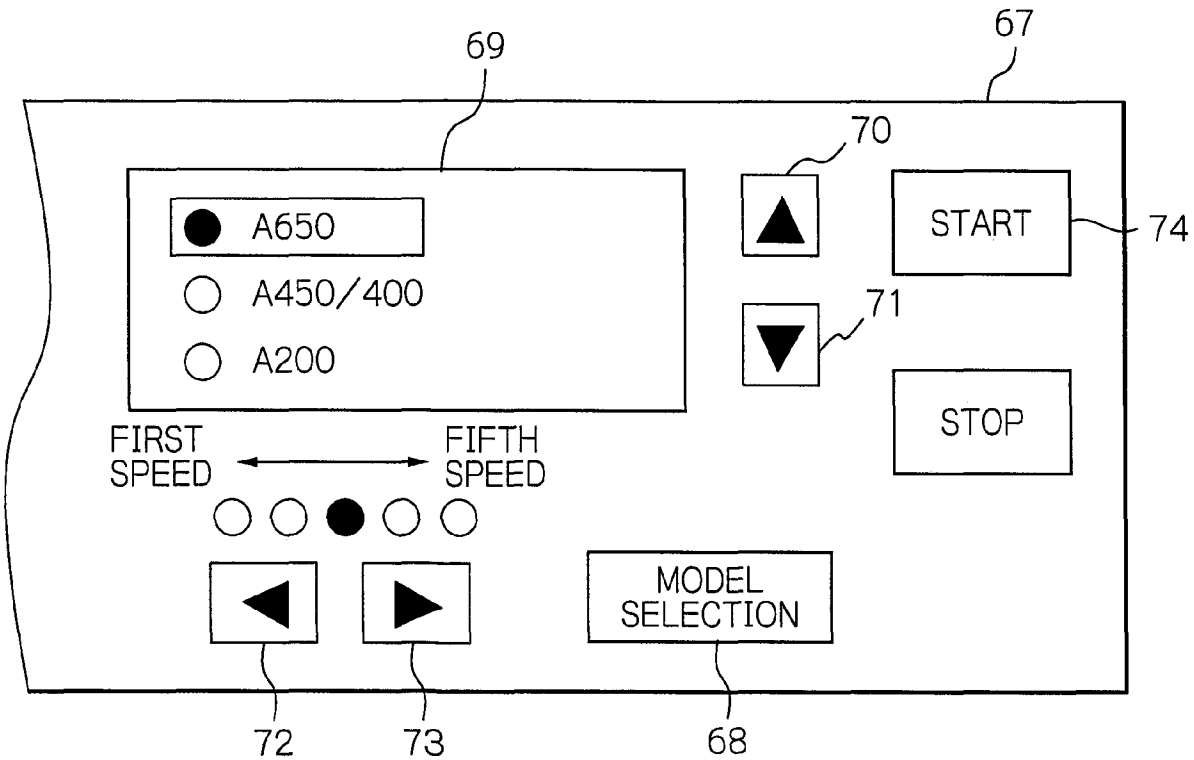
FIG. 5 is a front view showing a part of an operating panel of the ultraviolet ray irradiation apparatus.

FIG. 5 shows an operating panel 67 of the ultraviolet ray irradiation apparatus 30. When the control apparatus 62 of the ultraviolet ray irradiation apparatus 30 is unable to exchange information with the central control apparatus 61 of the stencil printing apparatus 50 online, a method of inputting the model type and the set printing speed of the connected stencil printing apparatus is selected in the ultraviolet ray irradiation apparatus 30.

First, the models (model names) of the connectable stencil printing apparatuses are displayed on a liquid crystal display unit 69 by pressing a model selection key 68. Next, the model name of the printer that is to perform the printing is selected by operating up and down scroll keys 70, 71, and the printer is set by pressing the model selection key 68 again. Next, the printing speed (the set printing speed during printing) is selected using speed keys 72, 73. The third speed is set as standard when the power is switched ON.

When a start key 74 in FIG. 5 is pressed, the ultraviolet lamp illumination circuit 75 in FIG. 3 is immediately switched ON and the ultraviolet lamp 39 is illuminated. Also, the air suction fan 37 is driven such that an air suction operation is begun. A slight amount of time is required for the output of the ultraviolet lamp 39 to reach a normal value, and therefore the waiting time is measured using a timer, and when the output of the ultraviolet lamp 39 reaches the normal value, rotational driving of the drive motor 35 is begun immediately to drive the perforated endless belt 34 to rotate. Here, the operator switches the print start key 57 of the stencil printing apparatus ON.

The control apparatus 62 determines the printed material discharge speed from information relating to the model and printing speed (the set printing speed during printing) set in the manner described above, and drives the perforated endless belt 34 to rotate by driving the drive motor 35 to rotate at a speed set slightly higher than the printed material discharge speed.

Hence, even when the ultraviolet ray irradiation apparatus 30 is offline, i.e. not electrically connected to the stencil printing apparatus 50, the problems that arise when the set printing speed differs according to the type of the connected printing apparatus can be solved, and by learning the type and set input speed of the connected printing apparatus, the printed material discharge speed can be learned accurately, whereby the ultraviolet ray irradiation apparatus side can be driven at an optimum belt conveyance speed corresponding to this speed. As a result, insufficient ultraviolet curing due to an excessively high speed can be eliminated, and jams caused by bends in the printing paper due to an insufficient conveyance speed can be prevented.

Various types of stencil printing apparatuses may be connected to the ultraviolet ray irradiation apparatus 30, and depending on each type, the set printing speed value and the surface movement speed of the endless belt 21 in the paper discharge conveyance apparatus 18 may vary. To set the surface movement speed of the perforated endless belt 34 in the printed material conveyance apparatus 31 of the ultraviolet ray irradiation apparatus 30 to an optimum value at all times, the printed material discharge speed of the connected stencil printer must be grasped as accurately as possible so that the surface movement speed of the perforated endless belt 34 can be set in accordance therewith. It is therefore desirable to know the name of the connected model and the set printing speed.

[5] Control Flow

Figure 7:
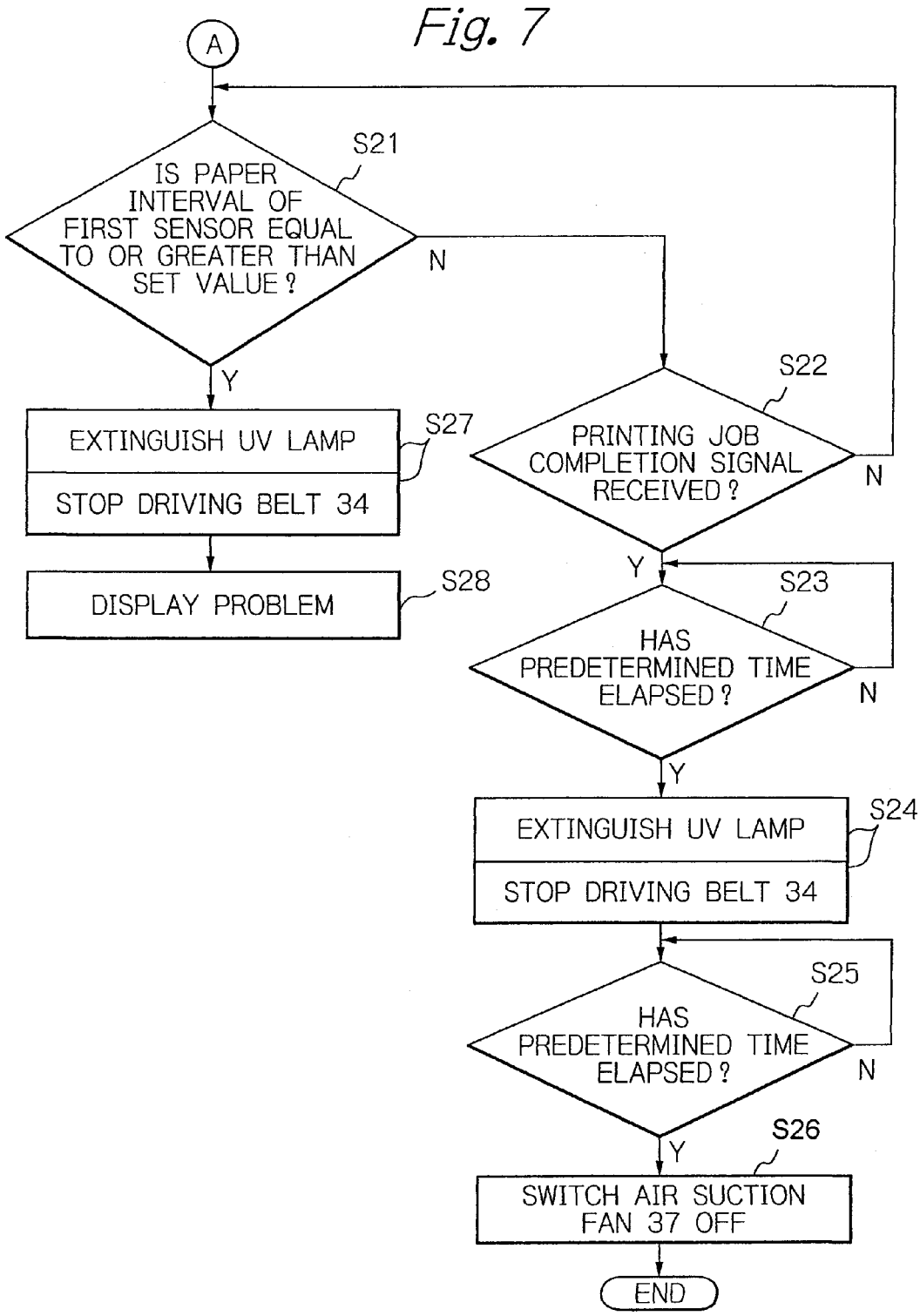
FIG. 7 is a view showing a part of a flowchart executed when the control system of the ultraviolet ray irradiation apparatus is online.

FIGS. 6 and 7 are views showing parts of a control system flowchart of the ultraviolet ray irradiation apparatus 30 according to the present invention. This flowchart relates to the first embodiment described above, in which the printing apparatus and ultraviolet ray irradiation apparatus are online and have a signal line for exchanging electric signals.

The control apparatus 62 shown in FIG. 3 controls the ultraviolet ray irradiation apparatus 30 in the sequence to be described below, shown in FIGS. 6 and 7, by communicating with the control apparatus 61 of the stencil printing apparatus over the signal line.

[5-1] Online Control Flow

An online control flow will be described using FIGS. 6 and 7.

In a step S1, the control apparatus 62 determines whether or not the printing drum of the stencil printing apparatus 50 uses UV curable ink by receiving information from the central control apparatus 61. When the printing drum does not use UV curable ink, the routine advances to a step S2, where the control apparatus 62 waits for the print start key 57 to be pressed. When it is determined that the print start key 57 has been pressed, a series of printing processes using non-UV curable ink is executed, and therefore the control apparatus 62 drives the air suction fan 37, without illuminating the UV lamp 39, in order to fix the printed material (step S3), permits the stencil printing apparatus 50 to start paper feeding via the central control apparatus 61 (step S4), and starts to drive the perforated endless belt 34 (i.e. the drive motor 22). The routine then advances to a step S6.

In the step S6, the control apparatus 62 waits to receive the printing job completion signal from the central control apparatus 61. Reception of the printing job completion signal indicates that printing is complete, and therefore the routine advances to a step S7, where the control apparatus 62 halts the air suction fan 37 and the perforated endless belt 34.

On the other hand, when it is determined in the step S1 that the printing drum of the stencil printing apparatus 50 uses UV curable ink, the following process is executed to fix the printed material printed with the UV curable ink. First, the routine advances to a step S8, where the control apparatus 62 waits for the print start key 57 to be pressed. Having determined that the print start key 57 has been pressed, the control apparatus 62 receives printing speed information from the central control apparatus 61 (step S9), and determines an appropriate drive speed of the perforated endless belt 34 for the printing speed (step S10).

Next, the control apparatus 62 illuminates the UV lamp 39 and drives the air suction fan 37 (step S11), whereupon the routine advances to a step S12. In the step S12, the control apparatus 62 waits for activation of the UV lamp 39, and when a predetermined time required for activation has passed, the routine advances to a step S13, where the control apparatus 62 transmits a signal permitting the start of paper feeding in the stencil printing apparatus 50 to the central control apparatus 61.

Next, in a step S14, the control apparatus 62 waits for the paper feeding rollers, including the call-up roller 3 and separating roller 4, to be driven, and having determined that the paper feeding rollers have been driven, starts driving the perforated endless belt 34 (i.e. the drive motor 22) in a step S15. The routine then advances to a step S16.

In a step S16, the control apparatus 62 waits for the first sensor 42 to detect the tip end of the printing paper, and while waiting for this detection, waits for a predetermined amount of time (a standard required time for the printing paper to reach the first sensor 42 from an arbitrary reference position with no conveyance problems) to pass in a step S17. If the predetermined amount of time passes, the control apparatus 62 determines that a problem such as a jam has occurred, and in a step S18, extinguishes the UV lamp 39 and halts the perforated endless belt 34. Then, in a step S19, the problem is displayed on a display unit such as the operating panel 67.

When the tip end of the printing paper is detected in the step S16 before the predetermined amount of time elapses in the step S17, the routine advances to a step S20, where the control apparatus 62 continues to illuminate the UV lamp 39 and drive the air suction fan 37. The routine then advances to a step S21 in FIG. 7. In the step S21, a determination is made as to whether or not the interval at which the first sensor 42 detects the tip end of the printing paper has reached or exceeded a standard predetermined time interval.

While waiting for the predetermined time interval to be reached in the step S21, the control apparatus 62 waits to receive the printing job completion signal from the central control apparatus 61 in a step S22*. Upon reception of the printing job completion signal, the control apparatus 62 waits for a predetermined amount of time (for example, a standard time required for the tip end portion of the printing paper to pass through the printed material conveyance apparatus 31 after passing through an arbitrary reference position) to elapse in a step 23. When it is determined in the step S23 that the predetermined amount of time has elapsed, this means that the printing paper has passed out of the ultraviolet ray irradiation apparatus 30, and therefore the routine advances to a step S24, where the UV lamp 39 is extinguished and the perforated endless belt 34 is halted. Further, in a step S25, the control apparatus 62 waits for a predetermined amount of time required for the printing paper to be delivered onto the paper discharge tray 44 to elapse, and having determined that the predetermined amount of time has elapsed, halts the air suction fan 37 in a step S26.

On the other hand, when it is determined in the step S21 that the predetermined time interval has been reached or exceeded, the routine advances to a step S27, where the UV lamp 39 is extinguished and the perforated endless belt 34 is halted. Then, in a step S28, the problem is displayed on a display unit such as that of the operating panel 67.

[5-2] Offline Control Flow

Figure 9:
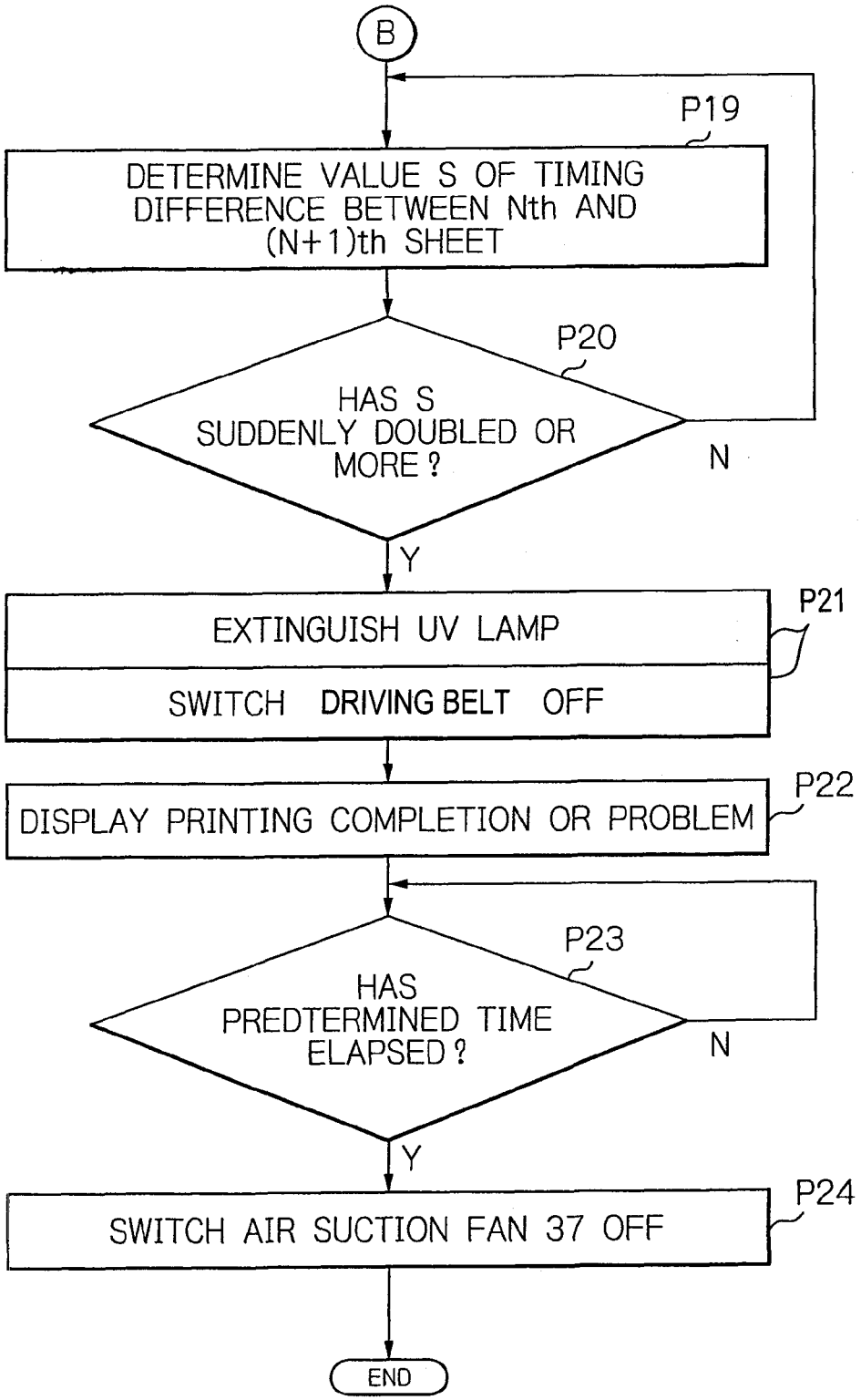
FIG. 9 is a view showing a part of a flowchart executed when the control system of the ultraviolet ray irradiation apparatus is offline.

FIGS. 8 and 9 are views showing parts of a control system flowchart of the ultraviolet ray irradiation apparatus according to the present invention. This flowchart relates to the second embodiment described above, in which the printing apparatus and ultraviolet ray irradiation apparatus are offline and do not have a signal line for exchanging electric signals.

The offline control flow will be described using FIGS. 8 and 9.

In a step P1, a determination is made as to whether or not model setting input (for example, input through the selection key 68 on the operating panel 67) has been performed. When model setting input has not been performed, the routine advances to a step P2. In a step P14, a determination is made as to whether or not speed setting input (for example, input through the speed keys 72, 73 on the operating panel 67) has been performed. When speed setting input has not been performed, the routine advances to the step P2. In the step P2, the control apparatus 62 waits for the print start key 57 to be pressed. Having determined that the print start key 57 has been pressed, the control apparatus 62 illuminates the UV lamp 39 and drives the air suction fan 37 in a step P3. The routine then advances to a step P4.

In the step P4, the perforated endless belt 34 is driven at a speed corresponding to a printing paper discharge speed of 90 sheets per minute (standard printing speed). In a step P5, the control apparatus 62 waits for the first sensor 42 to detect the fourth sheet of printing paper. When the fourth sheet of printing paper has been detected, the control apparatus 62 drives the perforated endless belt 34 at a speed corresponding to a printing paper discharge speed of 120 sheets per minute (maximum printing speed) in a step P6. In a step P7, the control apparatus 62 waits for the first sensor 42 to detect the seventh sheet of printing paper. When the seventh sheet of printing paper has been detected, the routine advances to a step P8, where the control apparatus 62 determines a discharge speed V from the detection timing difference between the sixth and seventh sheets. Note that the sixth and seventh sheets are conveyed at a stable speed following the elapse of the activation time, even in the maximum fifth speed (see FIG. 4).

In a step P9, the control apparatus 62 determines whether the determined discharge speed V is either 105 sheets per minute or 120 sheets per minute. If the discharge speed V is either one of these speeds, the control apparatus 62 continues to drive the perforated endless belt 34 at a speed corresponding to 120 sheets per minute in a step P10. The routine then advances to a step P19 in FIG. 9.

In a step P11, the control apparatus 62 determines whether the determined discharge speed V is either 75 sheets per minute or 90 sheets per minute. If the discharge speed V is neither of these speeds, the routine advances to a step P12, where the speed of the perforated endless belt 34 is modified to a speed corresponding to a discharge speed V of 60 sheets per minute. The routine then advances to the step P19 in FIG. 9. If the discharge speed V is either 75 sheets or 90 sheets per minute in the step P1, the routine advances to a step P13, where the speed of the perforated endless belt 34 is modified to a speed corresponding to a discharge speed V of 90 sheets per minute. The routine then advances to the step P19 in FIG. 9.

Meanwhile, when model setting in the step P1 and speed setting in the step P14 have both been performed, the routine advances to a step P15, where a printed material (printing paper) discharge speed R is determined from the input model and speed.

Next, in a step P16, the control apparatus 62 waits for the print start key 57 to be pressed, and having determined that the print start key 57 has been pressed, illuminates the UV lamp 39 and drives the air suction fan 37 in a step P17. The routine then advances to a step P18, where the perforated endless belt 34 is driven at a speed corresponding to the discharge speed R. The routine then advances to the step P19 in FIG. 9.

In the step P19 in FIG. 9, the control apparatus 62 determines a value S of the difference in the timing at which the first sensor 42 detects an Nth sheet of printing paper and an (N+1)th sheet of printing paper. In a step P20, a determination is made as to whether or not the value of S has suddenly doubled or more, and if so (i.e. if speed variation is present), the control apparatus 62 determines that an irregularity has occurred, and extinguishes the UV lamp 39 and halts the perforated endless belt 34 in a step P21. Furthermore, either printing completion or the problem is displayed on a display unit such as the operating panel 67 in a step P22. In a step P23, the control apparatus 62 waits for a predetermined amount of time required to deliver the printing paper to the paper discharge tray 44 to elapse, and having determined that the predetermined amount of time has elapsed, halts the air suction fan 37 in a step P24.

According to the present invention described above, the following effects are obtained.

(1) The ultraviolet ray irradiation apparatus has a signal line for exchanging electric signals with the printing apparatus, and performs control such that rotational driving of the belt drive motor of the ultraviolet ray irradiation apparatus is begun at substantially the same time as a printing drum rotation start signal or a paper feeding unit paper conveyance start signal is received, and the belt driving is halted after a predetermined amount of time has elapsed following reception of a printing completion signal. Thus, belt driving can be started and stopped at an optimum timing in accordance with the printing apparatus, and since the belt is not driven unnecessarily, noise and power consumption can be reduced. The belt is driven as soon as conveyance of the printed material begins, and when printing ends, the belt is not stopped until the printed material has passed securely through the paper discharge process. Therefore, the conveyance quality can be kept high.

(2) The ultraviolet ray irradiation apparatus has a signal line for exchanging electric signals with the printing apparatus, illuminates the ultraviolet lamp upon reception of a signal indicating that a print start command has been issued on the printing apparatus side, and when a predetermined amount of time has elapsed therefrom, transmits a signal to the printing apparatus side allowing rotation of the printing drum in the printing apparatus and paper conveyance by the paper feeding unit to begin. Hence, a situation in which printing is started immediately after the ultraviolet lamp is illuminated such that the printed material passes through the ultraviolet ray irradiation apparatus during lamp activation, when the light emission energy is insufficient, thereby causing a curing deficiency, can be prevented. Accordingly, the problem of insufficient curing during the initial stage of ultraviolet lamp illumination following activation thereof can be solved. Note that when the engraving start key is pressed, the lamp can be illuminated during the engraving period, and therefore this problem does not arise.

(3) The ultraviolet ray irradiation apparatus receives information relating to the discharge speed of the printed material discharge apparatus in the connected printing apparatus from the control apparatus on the printing apparatus side, and controls the drive motor of the belt type conveyance apparatus in the ultraviolet ray irradiation apparatus to rotate at a higher speed than the discharge speed of the printed material discharge apparatus. Hence, even when the speed setting on the printing apparatus side is arbitrarily variable, the ultraviolet ray irradiation apparatus side can be driven at an optimum belt conveyance speed corresponding thereto. As a result, sufficient ultraviolet curing can be achieved, and jams occurring due to mismatched conveyance speeds can be prevented.

(4) The ultraviolet ray irradiation apparatus is provided with a sensor for detecting the tip end of the printed material discharged to the vicinity of the printed material reception unit of the ultraviolet ray irradiation apparatus, determines a time difference between the timing at which the sensor detects the arrival of the tip end of the printed material and the timing at which the sensor detects the arrival of the tip end of the following printed material, determines the printed material discharge speed of the printing apparatus from a value thereof, and controls the drive motor of the belt type conveyance apparatus in the ultraviolet ray irradiation apparatus to a higher speed than the discharge speed of the printed material discharge apparatus. Hence, even when the ultraviolet ray irradiation apparatus is offline, i.e. not electrically connected to the printing apparatus, the speed at which the printed material is discharged from the printing apparatus can be detected, and the ultraviolet ray irradiation apparatus side can be driven at an optimum belt conveyance speed corresponding to this speed. As a result, insufficient ultraviolet curing due to an excessively high speed can be eliminated, and jams caused by bends in the printing paper due to an insufficient conveyance speed can be prevented.

(5) At the start of printing, the drive motor of the belt type conveyance apparatus in the ultraviolet ray irradiation apparatus is controlled to a higher speed than the printed material discharge speed at the maximum printing speed of the printing apparatus, the set printing speed or the printed material discharge speed is calculated from a time difference between the printed material tip end arrival timing of a predetermined sheet from a predetermined printing start point and the printed material tip end arrival timing of the following sheet, and thereafter, the drive motor of the belt type conveyance apparatus of the ultraviolet ray irradiation apparatus is controlled to a higher speed than the printed material discharge speed. Hence, when the ultraviolet ray irradiation apparatus is offline, i.e. not electrically connected to the printing apparatus, the discharge speed cannot be determined at the start of printing by the printing apparatus, but even so, the belt is driven at a sufficiently high speed, and therefore, regardless of the set printing speed, jams caused by bends in the printing paper due to an insufficient conveyance speed can be prevented. Furthermore, the set printing speed or printed material discharge speed is calculated from the time difference in the printed material tip end arrival timing while printing is underway, and thereafter, the ultraviolet ray irradiation apparatus side can be driven at an optimum belt conveyance speed corresponding to the printed material discharge speed. Hence, insufficient ultraviolet curing due to an excessively high speed can be eliminated, and jams caused by bends in the printing paper due to an insufficient conveyance speed can be prevented.

(6) The ultraviolet ray irradiation apparatus is provided with an operating panel unit on which a value of the set printing speed during printing in the connected printing apparatus is input, and the control apparatus of the ultraviolet ray irradiation apparatus determines the printed material discharge speed from input printing speed information and controls the drive motor of the belt type conveyance apparatus of the ultraviolet ray irradiation apparatus to a higher speed than the discharge speed of the printed material discharge apparatus. Hence, even when the ultraviolet ray irradiation apparatus is offline, i.e. not electrically connected to the printing apparatus, the speed at which the printed material is discharged from the printing apparatus can be learned, and the ultraviolet ray irradiation apparatus side can be driven at an optimum belt conveyance speed corresponding to this speed. Therefore, insufficient ultraviolet curing due to an excessively high speed can be eliminated, and jams caused by bends in the printing paper due to an insufficient conveyance speed can be prevented.

(7) The ultraviolet ray irradiation apparatus is provided with an operating panel unit on which a model of the connected printing apparatus is selected and input and a value of the set printing speed during printing is input, and the control apparatus of the ultraviolet ray irradiation apparatus determines the printed material discharge speed from input printing apparatus model information and printing speed information and controls the drive motor of the belt type conveyance apparatus in the ultraviolet ray irradiation apparatus to a higher speed than the discharge speed of the printed material discharge apparatus. Hence, even when the ultraviolet ray irradiation apparatus is offline, i.e. not electrically connected to the printing apparatus, the problems that arise when the set printing speed differs according to the type of the connected printing apparatus can be solved, and by learning the model and set input speed of the connected printing apparatus, the printed material discharge speed can be learned accurately, whereby the ultraviolet ray irradiation apparatus side can be driven at an optimum belt conveyance speed corresponding to this speed. As a result, insufficient ultraviolet curing due to an excessively high speed can be eliminated, and jams caused by bends in the printing paper due to an insufficient conveyance speed can be prevented.

(8) When no specific instruction is input into the operating panel unit, the ultraviolet ray irradiation apparatus controls the drive motor of the belt type conveyance apparatus of the ultraviolet ray irradiation apparatus to a higher speed than the printed material discharge speed using a printed material discharge speed determined from a standard printing speed of the connected printing apparatus as a reference. Hence, when the ultraviolet ray irradiation apparatus is offline, i.e. not electrically connected to the printing apparatus, the speed of the connected printing apparatus can be predicted stochastically without the need to input the model and set printing speed of the connected printing apparatus one by one, and as a result, jams can be prevented from occurring at the initial stage of printing. Further, by calculating the set printing speed or printed material discharge speed from the time difference in the printed material tip end arrival timing while printing is underway, the ultraviolet ray irradiation apparatus side can be driven thereafter at an optimum belt conveyance speed corresponding to the printed material discharge speed. As a result, insufficient ultraviolet curing due to excessive speed can be eliminated, and jams caused by bends in the printing paper due to an insufficient conveyance speed can be prevented.

(9) The conveyance speed of the belt type conveyance apparatus in the ultraviolet ray irradiation apparatus is set to be higher than the discharge speed of the printed material discharge apparatus in the printing apparatus by no less than 5% and no more than 20%. Hence, the ultraviolet ray irradiation apparatus side can be driven within an optimum belt conveyance speed range corresponding to the printed material discharge speed, and as a result, insufficient ultraviolet curing due to excessive speed can be eliminated, and jams caused by bends in the printing paper due to an insufficient conveyance speed can be prevented.

(10) A sensor is provided for detecting the tip end of the printed material discharged to the vicinity of the printed material reception unit of the ultraviolet ray irradiation apparatus, and when the sensor does not detect the arrival of the tip end of the following printed material after a predetermined amount of time has elapsed, rotational driving of the belt drive motor is halted. Hence, when a problem occurs on the printing apparatus side, the problem can be detected quickly, and measures such as halting the belt and extinguishing the lamp can be taken immediately. Even in an offline state, where the ultraviolet ray irradiation apparatus is not electrically connected to the printing apparatus, a problem on the printing apparatus side can be detected reliably, and the required measures, i.e. halting the belt and extinguishing the lamp, can be implemented.

Various modifications will become possible for those skilled in the art after receiving the teachings of the present disclosure, without departing from the scope thereof.

What is claimed is:

1. An ultraviolet ray irradiation apparatus for fixing a printed material, which is connected to a printed material discharge port of a printing apparatus and comprises a belt type conveyance device configured to aspirate a lower surface of a discharged printed material and conveying said discharged printed material, a drive motor configured to drive said belt, a control device configured to control the driving of said belt, and an ultraviolet ray irradiation unit configured to irradiate an image surface of said discharged and conveyed printed material with ultraviolet rays, wherein said ultraviolet ray irradiation apparatus has a signal line for exchanging electric signals with said printing apparatus, and performs control such that rotational driving of said belt drive motor of said ultraviolet ray irradiation apparatus is begun upon reception of a printing drum rotation start signal or a paper feeding unit paper conveyance start signal, and said belt driving is halted after a predetermined amount of time has elapsed following reception of a printing completion signal.

2. The ultraviolet ray irradiation apparatus for fixing a printed material as claimed in claim 1, wherein a sensor is provided for detecting a tip end of said printed material discharged to the vicinity of a printed material reception unit of said ultraviolet ray irradiation apparatus, and when said sensor does not detect the arrival of a tip end of a following printed material after a predetermined amount of time has elapsed, said rotational driving of said belt drive motor is halted.

3. An ultraviolet ray irradiation apparatus for fixing a printed material, which is connected to a printed material discharge port of a printing apparatus and comprises a belt type conveyance device configured to aspirate a lower surface of a discharged printed material and conveying said discharged printed material, a drive motor configured to drive said belt, a control device configured to control the driving of said belt, and an ultraviolet ray irradiation unit configured to irradiate an image surface of said discharged and conveyed printed material with ultraviolet rays, wherein said ultraviolet ray irradiation apparatus has a signal line for exchanging electric signals with said printing apparatus, illuminates an ultraviolet lamp upon reception of a signal indicating that a print start command has been issued on said printing apparatus side, and when a predetermined amount of time has elapsed therefrom, transmits a signal to said printing apparatus side allowing rotation of a printing drum of said printing apparatus and paper conveyance by a paper feeding unit to begin.

4. The ultraviolet ray irradiation apparatus for fixing a printed material as claimed in claim 3, wherein a sensor is provided for detecting a tip end of said printed material discharged to the vicinity of a printed material reception unit of said ultraviolet ray irradiation apparatus, and when said sensor does not detect the arrival of a tip end of a following printed material after a predetermined amount of time has elapsed, said rotational driving of said belt drive motor is halted.

5. An ultraviolet ray irradiation apparatus for fixing a printed material, which is connected to a printed material discharge port of a printing apparatus and comprises a belt type conveyance device configured to aspirate a lower surface of a discharged printed material and conveying said discharged printed material, a drive motor configured to drive said belt, a control device configured to control the driving of said belt, and an ultraviolet ray irradiation unit configured to irradiate an image surface of said discharged and conveyed printed material with ultraviolet rays, wherein said ultraviolet ray irradiation apparatus receives information relating to a discharge speed of a printed material discharge device in said connected printing apparatus from a control device on said printing apparatus side, and controls said drive motor of said belt type conveyance device in said ultraviolet ray irradiation apparatus to rotate at a higher speed than said discharge speed of said printed material discharge device.

6. The ultraviolet ray irradiation apparatus for fixing a printed material as claimed in claim 5, wherein a conveyance speed of said belt type conveyance device in said ultraviolet ray irradiation apparatus is set to be higher than said discharge speed of said printed material discharge device in said printing apparatus by no less than 5% and no more than 20%.

7. The ultraviolet ray irradiation apparatus for fixing a printed material as claimed in claim 5, wherein a sensor is provided for detecting a tip end of said printed material discharged to the vicinity of a printed material reception unit of said ultraviolet ray irradiation apparatus, and when said sensor does not detect the arrival of a tip end of a following printed material after a predetermined amount of time has elapsed, said rotational driving of said belt drive motor is halted.

* * * * *